United States Patent [19]

Huang

[11] Patent Number: 4,897,127

[45] Date of Patent: Jan. 30, 1990

[54] RAPIDLY SOLIDIFIED AND HEAT-TREATED MANGANESE AND NIOBIUM-MODIFIED TITANIUM ALUMINUM ALLOYS

[75] Inventor: Shyh-Chin Huang, Latham, N.Y.

[73] Assignee: General Electric Company, Schenectady, N.Y.

[21] Appl. No.: 253,659

[22] Filed: Oct. 3, 1988

[51] Int. Cl.[4] ..... C22F 1/18; B32B 15/14

[52] U.S. Cl. ..... 148/133; 75/245; 148/421; 420/418; 420/420

[58] Field of Search ..... 420/418, 420; 148/421, 148/133; 75/245

[56] References Cited

U.S. PATENT DOCUMENTS 4,661,316 4/1987 Hashimoto et al. ..... 420/418
4,746,374 5/1988 Froes et al. ..... 148/11.5 F
4,788,035 11/1988 Gigliotti et al. ..... 420/420
4,834,036 5/1989 Nishiyama et al. ..... 251/358

OTHER PUBLICATIONS

Binary-Alloy Phase Diagram, vol. 1, ed. Massalski et al., ASM, Metals Park, OH 1986, pp. 175-176.

*Primary Examiner*—Upendra Roy
*Attorney, Agent, or Firm*—Paul E. Rochford; James C. Davis, Jr.; James Magee, Jr.

[57] ABSTRACT

A TiAl composition is prepared to have high strength and to have improved ductility by altering the atomic ratio of the titanium and niobium to have what has been found to be a highly desirable effective aluminum concentration by addition of a combination of manganese and niobium according to the approximate formula $Ti_{52-42}Al_{46-50}Nb_{1-5}Mn_{1-3}$.

6 Claims, 6 Drawing Sheets

RAPIDLY SOLIDIFIED AND HEAT-TREATED MANGANESE AND NIOBIUM-MODIFIED TITANIUM ALUMINUM ALLOYS

CROSS-REFERENCE TO RELATED APPLICATIONS

The subject application relates to copending applications as follows: Serial No. 138,408; Serial No. 38,476; Serial No. 138,486; Serial No. 138,481; and Serial No. 138,407; filed concurrently Dec. 28, 1987. It also relates to Serial No. 201,984, filed June 3, 1988; Serial No. 293,035, filed Jan. 3, 1989; and Serial No. 252,622, filed Oct. 3, 1988.

The texts of these related applications are incorporated herein by reference.

BACKGROUND OF THE INVENTION

The present invention relates generally to alloys of titanium and aluminum. More particularly, it relates to alloys of titanium and aluminum which have been modified both with respect to stoichiometric ratio and with respect to manganese and niobium addition.

It is known that as aluminum is added to titanium metal in greater and greater proportions the crystal form of the resultant titanium aluminum composition changes. Small percentages of aluminum go into solid solution in titanium and the crystal form remains that of alpha titanium. At higher concentrations of aluminum (including about 25 to 35 atomic %) an intermetallic compound $Ti_3Al$ is formed. The $Ti_3Al$ has an ordered hexagonal crystal form called alpha-2. At still higher concentrations of aluminum (including the range of 50 to 60 atomic % aluminum) another intermetallic compound, TiAl, is formed having an ordered tetragonal crystal form called gamma.

The alloy of titanium and aluminum having a gamma crystal form and a stoichiometric ratio of approximately one is an intermetallic compound having a high modulus, a low density, a high thermal conductivity, good oxidation resistance, and good creep resistance. The relationship between the modulus and temperature for TiAl compounds to other alloys of titanium and in relation to nickel base super-alloys is shown in FIG. 1. As is evident from the figure the TiAl has the best modulus of any of the titanium alloys. Not only is the TiAl modulus higher at temperature but the rate of decrease of the modulus with temperature increase is lower for TiAl than for the other titanium alloys. Moreover, the TiAl retains a useful modulus at temperatures above those at which the other titanium alloys become useless. Alloys which are based on the TiAl intermetallic compound are attractive lightweight materials for use where high modulus is required at high temperatures and where good environmental protection is also required.

One of the characteristics of TiAl which limits its actual application to such uses is a brittleness which is found to occur at room temperature. Also, the strength of the intermetallic compound at room temperature needs improvement before the TiAl intermetallic compound can be exploited in structural component applications. Improvements of the TiAl intermetallic compound to enhance ductility and/or strength at room temperature are very highly desirable in order to permit use of the compositions at the higher temperatures for which they are suitable.

With potential benefits of use at light weight and at high temperatures, what is most desired in the TiAl compositions which are to be used is a combination of strength and ductility at room temperature. A minimum ductility of the order of one percent is acceptable for some applications of the metal composition but higher ductilities are much more desirable. A minimum strength for a composition to be useful is about 50 ksi or about 350 MPa. However, materials having this level of strength are of marginal utility and higher strengths are often preferred for some applications.

The stoichiometric ratio of TiAl compounds can vary over a range without altering the crystal structure. The aluminum content can vary from about 50 to about 60 atom percent. The properties of TiAl compositions are subject to very significant changes as a result of relatively small changes of one percent or more in the stoichiometric ratio of the titanium and aluminum ingredients. Also, the properties are similarly affected by the addition of relatively similar small amounts of ternary elements.

I have now discovered that further improvements can be made in the gamma TiAl intermetallic compounds by incorporating therein a combination of additive elements so that the composition not only contains a ternary additive element but also a quaternary additive element.

Furthermore, I have discovered that the composition including the quaternary additive element has a uniquely desirable combination of properties which include a desirably high ductility and a valuable oxidation resistance.

PRIOR ART

There is extensive literature on the compositions of titanium aluminum including the $Ti_3Al$ intermetallic compound, the TiAl intermetallic compounds and the $Ti_3Al$ intermetallic compound. A patent, U.S. 4,294,615, entitled "Titanium Alloys of the TiAl Type" contains an extensive discussion of the titanium aluminide type alloys including the TiAl intermetallic compound. A is pointed out in the patent in column 1, starting at line 50, in discussing TkAl's advantages and disadvantages relative to $Ti_3Al$:

"It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

"Those well skilled recognize that there is a substantial difference between the two ordered phases. Alloying and transformational behavior of $Ti_3Al$ resemble those of titanium as the hexagonal crystal structures are very similar. However, the compound TiAl has a tetragonal arrangement of atoms and thus rather different alloying characteristics. Such a distinction is often not recognized in the earlier literature."

The '615 patent does describe the alloying of TiAl with vanadium and carbon to achieve some property improvements in the resulting alloy.

The '615 patent discloses a composition containing niobium as follows: Ti-45Al-5.ONb.

A number of technical publications dealing with the titanium aluminum compounds as well as with the characteristics of these compounds are as follows:

1. E.S. Bumps, H.D. Kessler, and M. Hansen, "TitaniumAluminum System", *Journal of Metals,* TRANSACTIONS AIME, Vol. 194 (June 1952) pp. 609–614.
2. H.R. Ogden, D.J. Maykuth, W.L. Finlay, and R.I. Jaffee, "Mechanical Properties of High Purity Ti-Al Alloys", *Journal of Metals,* TRANSACTIONS AIME, Vol. 197 (Feb. 1953) pp. 267–272.

Two additional papers contain limited information about the mechanical behavior of TiAl base alloys modified by niobium. These two papers are as follows:

3. Joseph B. McAndrew, and H.D. Kessler, "Ti-36 Pct Al as a Base For High Temperature Alloys", *Journal of Metals,* TRANSACTIONS AIME (October 1956) pp. 1348–1353.
4. S.M.L. Sastry and H.A. Lipsitt, "Plastic Deformation of TiAl and $Ti_3Al$", Titanium 80 (Published by American Society for Metals, Warrendale, Pa.), Vol. 2 (1980) p. 1231.

The first paper above contains a statement that, "A Ti-35 pct Al-5 pct Cb specimen had a room temperature ultimate tensile strength of 62,360 psi, and a Ti-35 pct Al-7 pct Cb specimen failed in the threads at 75,800 psi". The two above alloys referred to in the quoted passage have approximate compositions in atomic percentages respectively of $Ti_{48}Al_{50}$ *l Nb2* and $Ti_{47}Al_{50}Nb_3$.

The second paper contains a conclusion regarding the influence of niobium additions on TiAl but offers no specific data in support of this conclusion. The conclusion is that: "The major influence of niobium additions to TiAl is a lowering of the temperature at which twinning becomes an important mode of deformation and thus a lowering of the ductile-brittle transition temperature of TiAl". The only niobium containing titanium aluminum alloy mentioned without any reference to properties or other descriptive data is Ti-36Al-4Nb. This corresponds in atomic percent to $Ti_{47.5}Al_{51}Nb_{1.5}$ a composition which is quite distinct from those taught and claimed by the Applicants herein as will become more clearly evident below.

U.S. Pat. No. 4,661,316 discloses titanium aluminide compositions which contain manganese as well as manganese plus other ingredients including niobium.

Two additional papers deal with titanium aluminides. These are:

5. Patrick L. Martin, Nadow G. Meddiratta, and Harry A. Lipsitt, "Creep Deformation of TiAl and TiAl +W Alloys" published in Metallurgical Transactions A, Vol. 14A (Oct. 1983) pp. 2170–2174.
6. P.L. Martin, H.A. Lipsitt, N.T. Nuhfer, and J.C. Williams, "The Effects of Alloying on the Microstructure and Properties of $Ti_3Al$ and TiAl", *Titanium* 80 (published by American Society for Metals, Warrendale, PA), vol. 2, pp. 1245–1254.

BRIEF DESCRIPTION OF THE INVENTION

One object of the present invention is to provide a method of forming a titanium aluminum intermetallic compound having improved ductility and related properties at room temperature.

Another object is to improve the properties of titanium aluminum intermetallic compounds at low and intermediate temperatures.

Another object is to provide an alloy of titanium and aluminum having improved properties and processability at low and intermediate temperatures.

Another object is to improve the combination of ductility and oxidation resistance of TiAl base compositions.

Still another object is to improve the oxidation resistance of TiAl compositions.

Yet another object is to make improvements in a set of strength, ductility and oxidation resistance properties.

Other objects will be in part apparent and in part pointed out in the description which follows.

In one of its broader aspects the objects of the present invention are achieved by providing a nonstoichiometric TiAl base alloy, and adding a relatively low concentration of manganese and a low concentration of niobium to the nonstoichiometric composition. The addition may be followed by rapidly solidifying the manganese- and niobiumcontaining nonstoichiometric TiAl intermetallic compound. Addition of manganese in the order of approximately 1 to 3 atomic percent and of niobium to the extent of 1 to 5 atomic percent is contemplated.

The rapidly solidified composition may be consolidated as by isostatic pressing and extrusion to form a solid composition of the present invention.

The alloy of this invention may also be produced in ingot form and may be processed by ingot metallurgy.

DETAILED DESCRIPTION OF THE INVENTION

EXAMPLES 1–3

Figure 1:
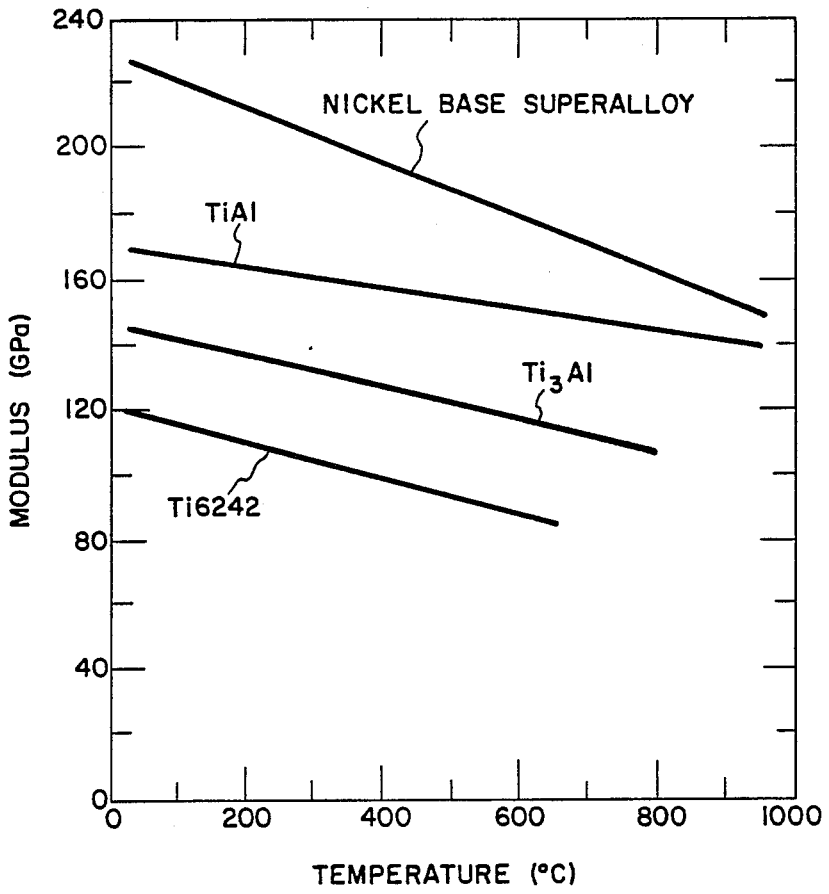
FIG. 1 is a graph illustrating the relationship between modulus and temperature for an assortment of alloys.

Three individual melts were prepared to contain titanium and aluminum in various stoichiometric ratios approximating that of TiAl. The compositions, annealing temperatures and test results of tests made on the compositions are set forth in Table I.

For each example the alloy was first made into an ingot by electro arc melting. The ingot was processed into ribbon by mel spinning in a partial pressure of argon. In both stages of the melting, a water-cooled copper hearth was used as the container for the melt in order to avoid undesirable melt-container reactions. Also care was used to avoid exposure of the hot metal to oxygen because of the strong affinity of titanium for oxygen.

The rapidly solidified ribbon was packed into a steel can which was evacuated and then sealed. The can was then hot isostatically pressed (HIPped) at 950° C. (1740° F.) for 3 hours under a pressure of 30 ksi. The HIPping can was machined off the consolidated ribbon plug. The HIPped sample was a plug about one inch in diameter and three inches long.

The plug was placed axially into a center opening of a billet and sealed therein. The billet was heated to 975° C. (1787° F.) and is extruded through a die to give a reduction ratio of about 7 to 1. The extruded plug was removed from the billet and was heat treated.

The extruded samples were then annealed at temperatures as indicated in Table I for two hours. The annealing was followed by aging at 1000° C. for two hours. Specimens were machined to the dimension of 1.5×3×25.4 mm (0.060× 0.120×1.0 in) for four point bending tests at room temperature. The bending tests were carried out in a 4-point bending fixture having an inner span of 10 mm (0.4 in) and an outer span of 20 mm (0.8 in). The load-crosshead displacement curves were recorded. Based on the curves developed the following properties are defined:

1. Yield strength is the flow stress at a cross head displacement of one thousandth of an inch. This amount of cross head displacement is taken as the first evidence of plastic deformation and the transition from elastic deformation to plastic deformation. The measurement of yield and/or fracture strength by conventional compression or tension methods tends to give results which are lower than the results obtained by four point bending as carried out in making the measurements reported herein. The higher levels of the results from four point bending measurements should be kept in mind when comparing these values to values obtained by the conventional compression or tension methods. However, the comparison of measurements results in the examples herein is between four point bending tests for all samples measured and such comparisons are quite valid in establishing the differences in strength properties resulting from differences in composition or in processing of the compositions.

2. Fracture strength is the stress to fracture.

3. Outer fiber strain is the quantity of 9.71hd, where h is the specimen thickness in inches and d is the cross head displacement of fracture in inches. Metallurgically, the value calculated represents the amount of plastic deformation experienced at the outer surface of the bending specimen at the time of fracture.

Figure 2:
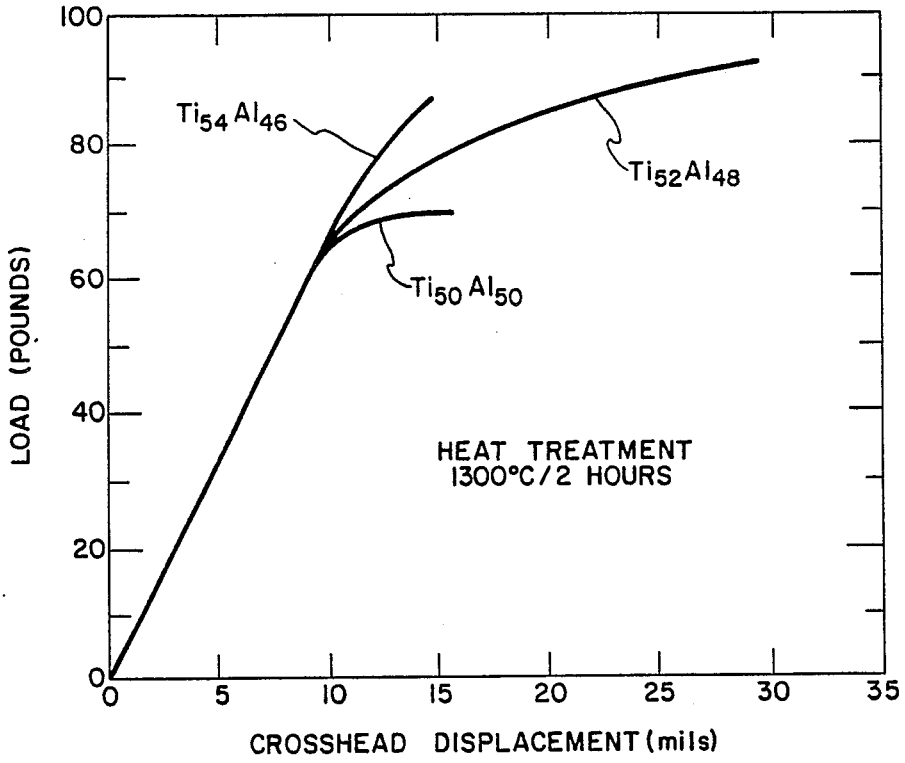
FIG. 2 is a graph illustrating the relationship between load in pounds and crosshead displacement in mils for TiAl compositions of different stoichiometry tested in 4-point bending.
Figure 3:
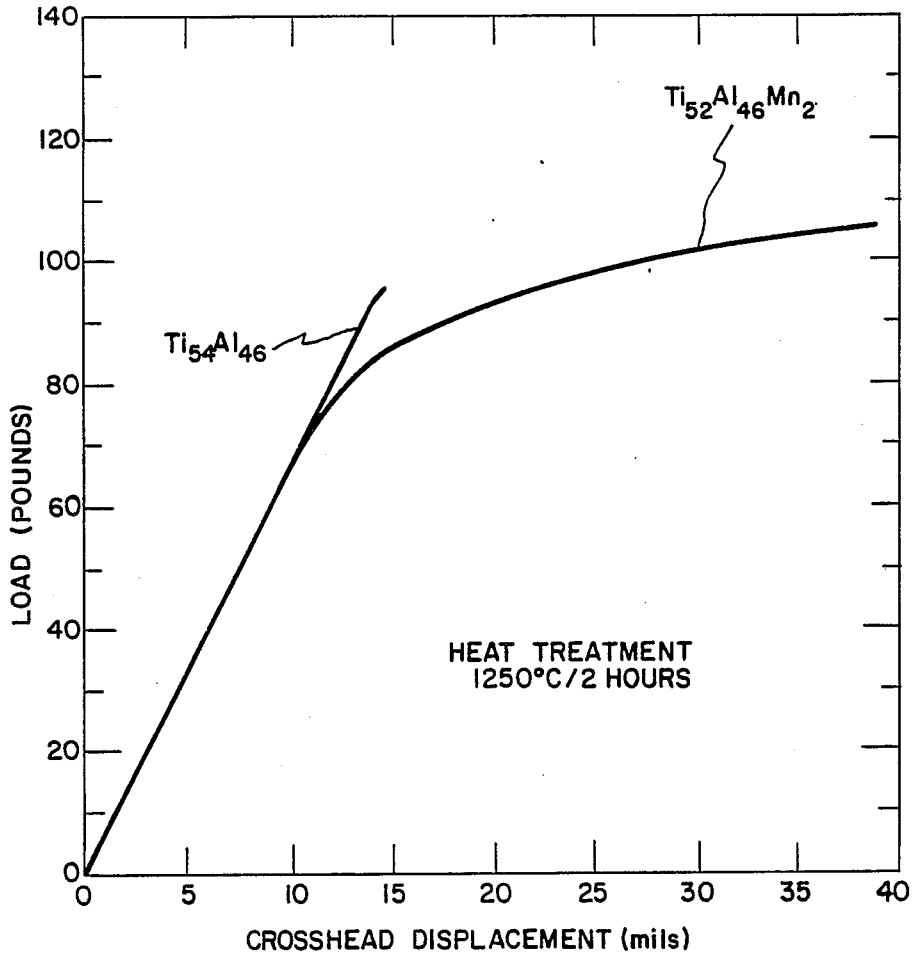
FIG. 3 is a graph similar to that of FIG. 2 but illustrating the relationship of FIG. 2 for $Ti_{52}Al_{46}Mn_2$.

The results are listed in the following Table I. Table I contains data on the properties of samples annealed at 1300° C. and further data on these samples in particular is given in FIG. 2.

TABLE I

| Ex. No. | Gamma Alloy No. | Comp-osit. (at. %) | Anneal Temp (°C.) | Yield Strength (ksi) | Fracture Strength (ksi) | Outer Fiber Strain (%) |
|---|---|---|---|---|---|---|
| 1 | 83 | $Ti_{54}Al_{46}$ | 1250 | 131 | 132 | 0.1 |
| | | | 1300 | 111 | 120 | 0.1 |
| | | | 1350 | —* | 58 | 0 |
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| | | | 1400 | 70 | 85 | 0.2 |
| 3 | 85 | $Ti_{50}Al_{50}$ | 1250 | 83 | 92 | 0.3 |
| | | | 1300 | 93 | 97 | 0.3 |
| | | | 1350 | 78 | 88 | 0.4 |

*No measureable value was found because the sample lacked sufficient ductility to obtain a measurement.

It is evident from the data of this table that alloy 12 for Example 2 exhibited the best combination of properties. This confirms that the properties of Ti-Al compositions are very sensitive to the Ti/Al atomic ratios and to the heat treatment applied. Alloy 12 was selected as the base alloy for further property improvements based on further experiments which were performed as described below.

It is also evident that the anneal at temperatures between 1250° C. and 1350° C. results in the test specimens having desirable levels of yield strength, fracture strength and outer fiber strain. However, the anneal at 1400° C. results in a test specimen having a significantly lower yield strength (about 20% lower); lower fracture strength (about 30% lower) and lower ductility (about 78% lower ) than a test specimen annealed at 1350° C. The sharp decline in properties is due to a dramatic change in microstructure due in turn to an extensive beta transformation at temperatures appreciably above 1350° C. EXAMPLES 4 -1

Ten additional individual melts were prepared to contain titanium and aluminum in designated atomic ratios as well as additives in relatively small atomic percents.

Each of the samples was prepared as described above with reference to Examples 1 -3.

The compositions, annealing temperatures, and test results of tests made on the compositions are set forth in Table II in comparison to alloy 12 as the base alloy for this comparison.

TABLE II

| Ex. No. | Gamma Alloy No. | Composit. (at. %) | Anneal Temp. (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 4 | 22 | $Ti_{50}Al_{47}Ni_3$ | 1200 | —* | 131 | 0 |
| 5 | 24 | $Ti_{52}Al_{46}Ag_2$ | 1200 | —* | 114 | 0 |
| | | | 1300 | 92 | 117 | 0.5 |
| 6 | 25 | $Ti_{50}Al_{48}Cu_2$ | 1250 | —* | 83 | 0 |
| | | | 1300 | 80 | 107 | 0.8 |
| | | | 1350 | 70 | 102 | 0.9 |
| 7 | 32 | $Ti_{54}Al_{45}Hf_1$ | 1250 | 130 | 136 | 0.1 |
| | | | 1300 | 72 | 77 | 0.1 |
| 8 | 41 | $Ti_{52}Al_{44}Pt_4$ | 1250 | 132 | 150 | 0.3 |
| 9 | 45 | $Ti_{51}Al_{47}C_2$ | 1300 | 136 | 149 | 0.1 |
| 10 | 57 | $Ti_{50}Al_{48}Fe_2$ | 1250 | —* | 89 | 0 |

TABLE II-continued

| Ex. No. | Gamma Alloy No. | Composit. (at. %) | Anneal Temp. (°C.) | Yield Strength (ksi) | Fracture Strength (ksi) | Outer Fiber Strain (%) |
|---|---|---|---|---|---|---|
| | | | 1300 | —* | 81 | 0 |
| | | | 1350 | 86 | 111 | 0.5 |
| 11 | 82 | $Ti_{50}Al_{48}Mo_2$ | 1250 | 128 | 140 | 0.2 |
| | | | 1300 | 110 | 136 | 0.5 |
| | | | 1350 | 80 | 95 | 0.1 |
| 12 | 39 | $Ti_{50}Al_{46}Mo_4$ | 1200 | —* | 143 | 0 |
| | | | 1250 | 135 | 154 | 0.3 |
| | | | 1300 | 131 | 149 | 0.2 |
| 13 | 20 | $Ti_{49.5}Al_{49.5}Er_1$ | + | + | + | + |

*See asterisk note to Table I.
+ Material fractured during machining to prepare test specimens.

For Examples 4 and 5 heat treated at 1200° C., the yield strength was unmeasurable as the ductility was found to be essentially nil. For the specimen of Example 5 which was annealed at 1300° C., the ductility increased, but it was still undesirably low.

For Example 6 the same was true for the test specimen annealed at 1250° C. For the specimens of Example 6 which were annealed at 1300 and 1350° C. the ductility was significant but the yield strength was low.

None of the test specimens of the other Examples were found to have any significant level of ductility.

It is evident from the results listed in Table II that the sets of parameters involved in preparing compositions for testing are quite complex and interrelated. One parameter is the atomic ratio of the titanium relative to that of aluminum. From the data plotted in FIG. 2 it is evident that the stoichiometric ratio or non-stoichiometric ratio has a strong influence on the test properties which formed for different compositions.

Another set of parameters is the additive chosen to be included into the basic TiAl composition. A first parameter of this set concerns whether a particular additive acts as a substituent for titanium or for aluminum. A specific metal may act in either fashion and there is no simple rule by which it can be determined which role an additive will play. The significance of this parameter is evident if we consider addition of some atomic percentage of additive X.

If X acts as a titanium substituent then a composition $Ti_{48}Al_{48}X_4$ will give an effective aluminum concentration of 48 atomic percent and an effective titanium concentration of 52 atomic percent.

If by contrast the X additive acts as an aluminum substituent then the resultant composition will have an effective aluminum concentration of 52 percent and an effective titanium concentration of 48 atomic percent.

Accordingly the nature of the substitution which takes place is very important but is also highly unpredictable.

Another parameter of this set is the concentration of the additive.

Still another parameter evident from Table II is the annealing temperature. The annealing temperature which produces the best strength properties for one additive can be seen to be different for a different additive. This can be seen by comparing the results set forth in Example 6 with those set forth in Example 7.

In addition there may be a combined concentration and annealing effect for the additive so that optimum property enhancement, if any enhancement is found, can occur at a certain combination of additive concentration and annealing temperature so that higher and lower concentrations and/or annealing temperatures are less effective in providing a desired property improvement.

The content of Table II makes clear that the results obtainable from addition of a ternary element to a non-stoichiometric TiAl composition are highly unpredictable and that most test results are unsuccessful with respect to ductility or strength or to both. EXAMPLES 14 -17.

A further parameter of the titanium aluminide alloys which include additives is that combinations of additives do not necessarily result in additive combinations of the individual advantages resulting from the individual and separate inclusion of the same additives.

Four additional TiAl based samples were prepared as described above with reference to Examples 1-3 to contain individual additions of vanadium, niobium and tantalum as listed in Table III. These compositions are the optimum compositions reported in copending applications S.N. 138,476; 138,408; and 138,485, respectively.

The fourth composition is a composition which combines the vanadium, niobium and tantalum into a single alloy designated in Table III to be alloy 48.

From Table III it is evident that the individual additions vanadium, niobium and tantalum are able on an individual basis in Examples 14, 15 and 16 to each lend substantial improvement to the base TiAl alloy. However, these same additives when combined into a single combination alloy do not result in a combination of the individual improvements in an additive fashion. Quite the reverse is the case.

In the first place the alloy 48 which was annealed at the 1350° C. temperature used in annealing the individual alloys was found to result in production of such a brittle material that it fractured during machining to prepare test specimens.

Secondly the results which are obtained for the combined additive alloy annealed at 1250° C. are very inferior to those which are obtained for the separate alloys containing the individual additives.

In particular with reference to the ductility it is evident that the vanadium was very successful in substantially improving the ductility in the alloy 14 of Example 14. However, when the vanadium is combined with the other additives in alloy 48 of Example 17 the ductility improvement which might have been achieved is not achieved at all. In fact the ductility of the base alloy is reduced to a value of 0.1.

Further with reference to the oxidation resistance the niobium additive of alloy 40 clearly shows a very substantial improvement in the 4 $mg/cm^2$ weight loss of alloy 40 as compared to the 31 $mg/cm^2$ weight loss of the base alloy. The test of oxidation, and the complementary test of oxidation resistance, involves heating a sample to be tested at a temperature of 982° C. for a period of 48 hours. After the sample has cooled it is scraped to remove any oxide scale. By weighing the sample both before and after the heating and scraping a weight difference can be determined. Weight loss is determined in mg/cm$^2$ by dividing the total weight loss in grams by the surface area of the specimen in square centimeters. This oxidation test is the one used for all measurements of oxidation or oxidation resistance as set forth in this application.

For the alloy 60 with the tantalum additive the weight loss for a sample annealed at 1325° C. was determined to be 2 mg/cm$^2$ and this is again compared to the 31 mg/cm$^2$ weight loss for the base alloy. In other words on an individual additive basis both niobium and tantalum additives were very effective in improving oxidation resistance of the base alloy.

However, as is evident from Example 17, results listed in Table III alloy 48 which contained all three additives, vanadium, niobium and tantalum in combination, the oxidation is increased to about double that of the base alloy. This is seven times greater than alloy 40 which contained the niobium additive above and about 15 times greater than alloy 60 which contained the tantalum additive alone.

pending application S.N. 138,485 it is disclosed that addition of tantalum results in improvements in ductility.

In other words, it has been found that vanadium can individually contribute advantageous ductility improvements to titanium aluminum compound and that tantalum can individually contribute to ductility and oxidation improvements. It has been found separately that niobium additives can contribute beneficially to the strength and oxidation resistance properties of titanium aluminum. However, the applicant has found as is indicated from this Example 17, that when vanadium, tantalum, and niobium are used together and are combined as additives in an alloy composition, the alloy composition is not benefited by the additions but rather there is a net decrease or loss in properties of the TiAl which contains the niobium, the tantalum, and the vanadium additives. This is evident from Table III.

From this it is evident that while it may seem that if two or more additive elements individually improve TiAl that their use together should render further improvements to the TiAl, it is found nevertheless that such additions are highly unpredictable and that, in fact, for the combined additions of vanadium, niobium and tantalum a net loss of properties result from the combined use of the combined additives together rather than some combined beneficial overall gain of properties.

TABLE III

| Example Number | Alloy Number | Composition (at. %) | Annealing Temperature (°C.) | Yield Strength (ksi) | Fracture Strength (ksi) | Outer Fiber Strain (%) | Weight Loss After 48 hrs. at 982° C.(mg/cm2) |
|---|---|---|---|---|---|---|---|
| 2 | 12 | $Ti_{52}Al_{48}$ | 1250 | 130 | 180 | 1.1 | —* |
| | | | 1300 | 98 | 128 | 0.9 | —* |
| | | | 1350 | 88 | 122 | 0.8 | 31 |
| 14 | 14 | $Ti_{49}Al_{48}V_3$ | 1300 | 94 | 145 | 1.6 | 27 |
| | | | 1350 | 84 | 136 | 1.5 | —* |
| 15 | 40 | $Ti_{50}Al_{46}Nb_4$ | 1250 | 136 | 167 | 0.5 | —* |
| | | | 1300 | 124 | 176 | 1.0 | 4 |
| | | | 1350 | 86 | 100 | 0.1 | —* |
| 16 | 60 | $Ti_{48}Al_{48}Ta_4$ | 1250 | 120 | 147 | 1.1 | —* |
| | | | 1300 | 106 | 141 | 1.3 | —* |
| | | | 1325 | —* | —* | —* | 2 |
| | | | 1350 | 97 | 137 | 1.5 | —* |
| | | | 1400 | 72 | 92 | 0.2 | —* |
| 17 | 48 | $Ti_{49}Al_{45}V_2Nb_2Ta_2$ | 1250 | 106 | 107 | 0.1 | 60 |
| | | | 1350 | + | + | + | —* |

*Not measured.
+ Material fractured during machining to prepare test specimen.

The individual advantages or disadvantages which result from the use of individual additives repeat reliably as these additions are used individually over and over again. However, when additives are used in combination the effect of an additive in the combination in a base alloy can be quite different from the effect of the additive when used individually and separately in the same base alloy. Thus, it has been discovered that addition of vanadium is beneficial to the ductility of titanium aluminum compositions and this is disclosed and discussed in the copending application for patent S.N. 138,476. Further, one of the additives which has been found to be beneficial to the strength of the TiAl base and which is described in copending application Serial No. 138,408, filed Dec. 28, 1987 as discussed above is the additive niobium. In addition it has been shown by the McAndrew paper discussed above that the individual addition of niobium additive to TiAl base alloy can improve oxidation resistance. Similarly the individual addition of tantalum is taught by McAndrew as assisting in improving oxidation resistance. Furthermore, in co- However, from Table 3 above, it is evident that the alloy containing the combination of the vanadium, niobium and tantalum additions has far worse oxidation resistance than the base TiAl 12 alloy of Example 2. Here again the combined inclusion of additives which improve a property on a separate and individual basis have been found to result in a net loss in the very property which is improved when the additives are included on a separate and individual basis. EXAMPLES 18 through 21

Four additional samples were prepared as described above with reference to Examples 1 -3 to contain manganese modified titanium aluminide having compositions respectively as listed in Table IV.

Table IV summarizes the bend test results on all of the alloys both standard and modified under the various heat treatment conditions deemed relevant.

TABLE IV

Four-Point Bend Properties of Mn-Modified TiAl Alloys

| Ex. | Gamma Alloy Number | Composition (at. %) | Annealing Temperature (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.0 |
| | | | 1300 | 98 | 128 | 0.9 |
| | | | 1350 | 88 | 122 | 0.9 |
| 18 | 37 | $Ti_{52}Al_{46}Mn_2$ | 1250 | 111 | 167 | 1.6 |
| | | | 1300 | 98 | 143 | 0.8 |
| | | | 1350 | 70 | 90 | 0.2 |
| 19 | 54 | $Ti_{50}Al_{48}Mn_2$ | 1250 | 106 | 125 | 0.5 |
| | | | 1300 | 95 | 111 | 0.3 |
| | | | 1350 | —* | 63 | 0 |
| 20 | 50 | $Ti_{52}Al_{44}Mn_4$ | 1250 | 72 | 90 | 0.2 |
| 21 | 61 | $Ti_{48}Al_{48}Mn_4$ | 1250 | 109 | 136 | 0.6 |
| | | | 1300 | 97 | 132 | 0.8 |
| | | | 1350 | 92 | 120 | 0.7 |

*No measurable value was found because the sample lacked sufficient ductility to obtain a measurement.

From the results listed in Table IV, it is evident that, based on the four-point bend testing the manganese additive has an influence on the strength and ductility properties of the resultant alloys. Alloy 37 shows a distinct improvement in ductility when annealed at 1250° C. without a loss of strength which compares in percentage to the 60% gain in ductility.

For the most part, the values of strength and ductility of the other alloys of the series of tests of Table IV are lower than those of the base $Ti_{52}Al_{48}$ alloy.

The above samples were prepared as described in Examples 1–3. Also, the above samples of Examples 1–21 were tested by the four-point bending test. EXAMPLES 22 and 23

Two samples of alloy identified as alloys 69 for Example 23 and 78 for Example 22 were prepared as described in Examples 1 to 3 above.

Tensile properties and weight loss data from high temperature heating were determined for these alloys. The samples were tested in conventional fashion by forming conventional tensile bars and by testing these bars in conventional tensile testing equipment as distinct from the four point bending tests used for previous examples. The data collected is set forth in Table V immediately below. Table V also contains data for Examples 2 and 19. Data is given above in Tables I and IV, respectively, or the four-point bending measurements for alloys 12 and 54. Data is given in the Table V below on the properties of these two alloys 12 and 54, as well as the other alloys 78 and 69, based on conventional tensile testing through the use of conventional tensile bars. Further, Table V contains data on weight loss due to oxidation of the surface of alloy specimens.

For Example 2 the annealing temperature employed on the tensile test specimen was 1300° C. For the three samples of the alloy 54 of Example 19, the samples were individually annealed at the three different temperatures listed in Table V and specifically 1250° C, 1275° C and 1300° C. Following this annealing treatment for approximately two hours the samples were subjected to conventional tensile testing and the results again are listed in Table V for the three separately treated tensile test specimens.

It will be appreciated that in general in metallurgical practice the yield strength determined by tensile bar elongation is a more generally accepted measure for engineering purposes. The close correlation of data obtained by four-point bending testing and data detained by conventional tensile testing of tensile bars is well established for this class of alloys as has been set forth in copending application Serial No. 201,984, filed June 3, 1988

Considering now the data of Table V it is evident that very unique and remarkable improvement in oxidation resistance is achieved for alloy 69 of Example 23 with essentially no loss of strength or ductility.

If these test results are considered in greater detail it is evident that the base alloy 12 has high yield strength and tensile strength coupled with favorable ductility but that the base alloy has poor resistance to oxidation at the high temperature of 980° C. at which the tests were made. The weight loss of the base alloy is 31 mg.cm$^2$ after 48 hours of heating at the 980° C. temperature.

The oxidation resistance of alloy 78 containing 2 atomic percent niobium was measured and found to be

TABLE V*

| Example No. | Alloy No. | Composition (at. %) | Annealing Temperature (°C.) | Yield Strength (psi) | Tensile Strength (psi) | Plastic Elongation (%) | Weight loss after 48 hr. at 980° C. (mg/cm$^2$) |
|---|---|---|---|---|---|---|---|
| 2 | 12 | $Ti_{52}Al_{48}$ | 1300 | 77 | 92 | 2.1 | + |
| | | | 1350 | + | + | + | 31 |
| 22 | 78 | $Ti_{50}Al_{48}Nb_2$ | 1325 | + | + | + | 7 |
| 19 | 54 | $Ti_{50}Al_{48}Mn_2$ | 1250 | 79 | 83 | 1.4 | + |
| | | | 1275 | 75 | 86 | 1.9 | + |
| | | | 1300 | 71 | 76 | 0.8 | 49 |
| 23 | 69 | $Ti_{48}Al_{48}Mn_2Nb_2$ | 1300 | 73 | 86 | 1.9 | + |
| | | | 1325 | 70 | 80 | 1.5 | + |
| | | | 1350 | 65 | 84 | 2.3 | 6 |

+ Not measured.

*The data in this Table is based on conventional tensile testing rather than on the four-point bending testing as described above and as included in Tables I–IV above.

about 7 mg/cm$^2$ thus demonstrating better than a fourfold improvement.

Alloy 54 of Example 19 containing 2 atomic percent manganese is included for comparison. It displayed significant strength and ductility but very low resistance to oxidation at elevated temperature. The oxidation weight loss was found to be almost 60higher than that of the base alloy.

However, a finding which was deemed to be particularly remarkable is the results obtained from tensile and oxidation testing of an alloy containing both the manganese and niobium additives. This alloy has strength and ductility values quite close to those of the base alloy. The values are quite comparable to those of alloy 54 containing the 2 atomic percent manganese.

What is most striking, however, is the low weight loss from the high temperature heating. The weight loss value is less than one-fifth that of the base alloy and less than one-eighth that of the manganese containing alloy.

It is known from Example 17 in Table III above that the addition of more than one additive elements each of which is effective individually in improving and in contributing to an improvement of different properties of the TiAl compositions, that nonetheless when more than one additive is employed in concert and combination as is done in Example 17, the result is essentially negative in that the combined addition results in a decrease in desired overall properties rather than an increase. Accordingly, it is very surprising to find that by the addition of two elements and specifically manganese and niobium to bring the additive level of the TiAl to the 4 atomic percent level and employing a combination of two differently acting additives that a substantial further increase in the desirable overall property of the alloy of the TiAl composition is achieved. In fact, the combination of the best tensile properties coupled with lowest weight loss levels achieved in all of the tests on materials prepared and listed in the application are achieved through use of the combined manganese and niobium additive combination.

Figure 4:
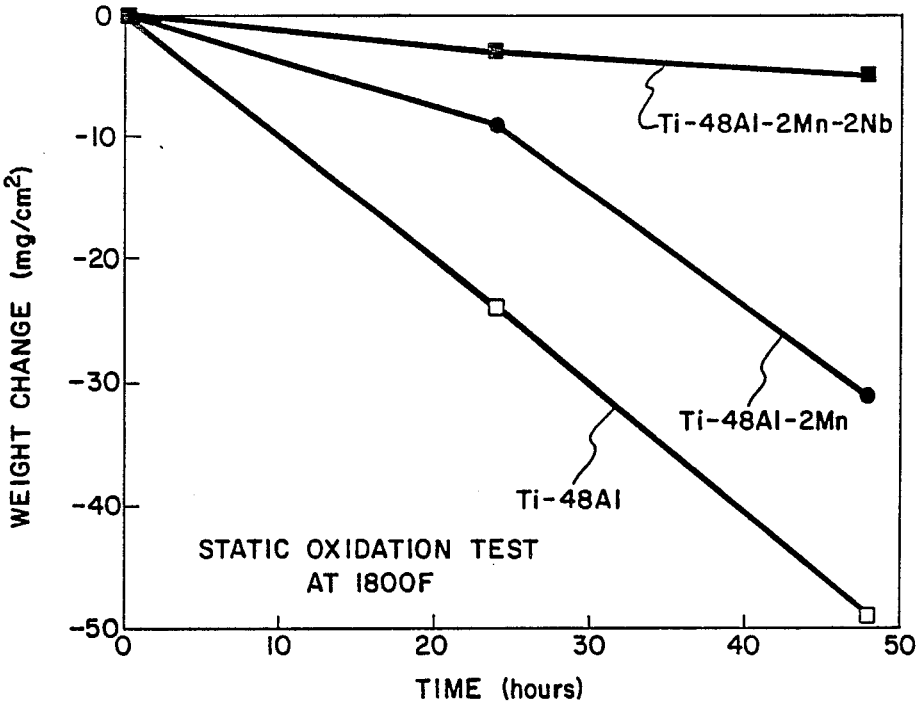
FIG. 4 is a graph displaying comparative oxidation resistance properties.

The oxidation test results are plotted in FIG. 4.

The oxidation test itself is carried out by heating the article to be tested to 988° C. for 48 hours. After cooling, the surface of the article is scraped to remove loose oxide coating. The weight of coating removed is determined in milligrams and the weight is divided by the number of square centimeters of surface of the article to determine milligrams of oxide removed per square centimeter.

Figure 5:
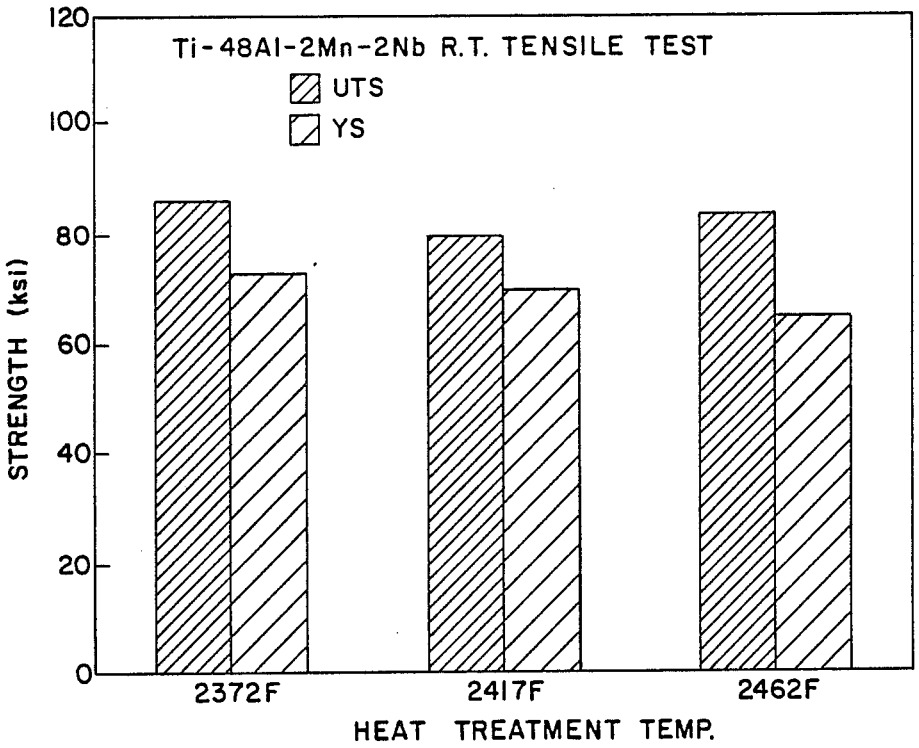
FIG. 5 is a bar graph displaying strength in ksi for samples given of different heat treatments.
Figure 6:
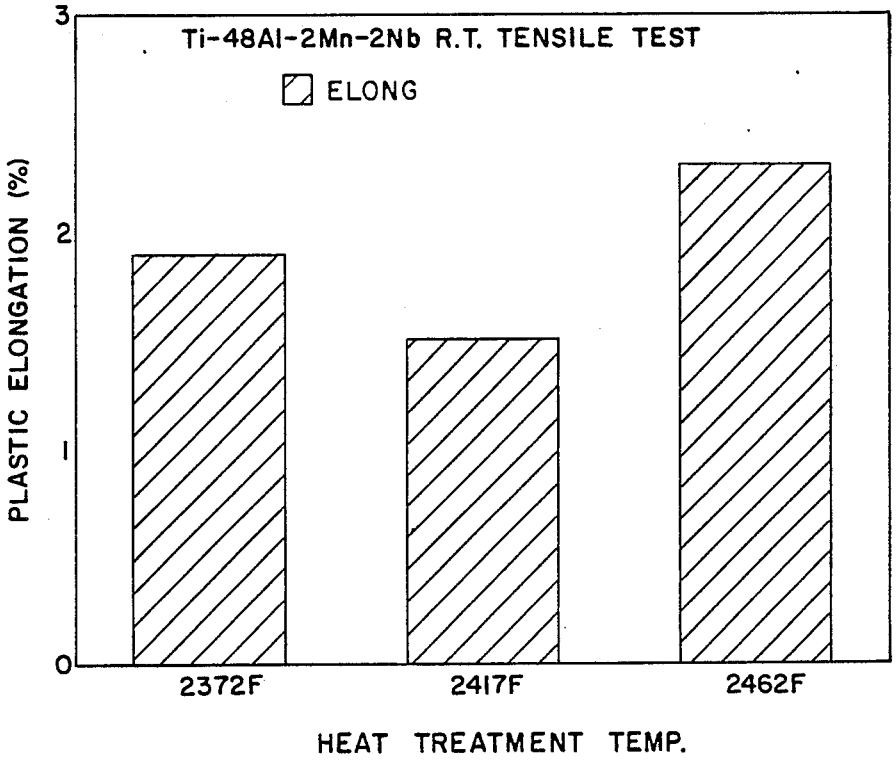
FIG. 6 is a similar graph displaying ductility in relation to temperature of heat treatment.

The strength and ductility test results of Table VI are plotted respectively in FIGS. 5 and 6.

The alloy of the present invention is suitable for use in components such as components of jet engines and other gas turbines which components display high strength at high temperatures. Such components may be for example swirl-less, exhaust components, LPT blades or vanes, component vanes or ducts.

The present invention includes a method for improving the oxidation resistance of such components of gas turbines by incorporating in the TiAl alloy from which they are made an oxidation resisting additive. The additive is a manganese and niobium additive as taught in this application. Accordingly, the method is one to reduce oxidation of TiAl structural members to be used at high temperature in the atmosphere by including in the TiAl a small but effective amount of manganese and niobium as taught herein.

The alloy may also be employed in reinforced composite structures substantially as described in copending application S.N. 010,882 filed Feb. 4, 1987 and assigned to the same assignee as the subject application the text of which application is incorporated herein by reference.

What is claimed is:

1. A niobium and manganese modified titanium aluminum alloy product consisting essentially of titanium, aluminum, niobium and manganese in the following approximate atomic ratio:

$$Ti_{52-42}Al_{46-50}Nb_{1-5}Mn_{1-3},$$

said alloy having been rapidly solidified and heat treated thereby giving a ductility of at least 2.0.

2. A niobium and manganese modified titanium aluminum alloy product consisting essentially of titanium, aluminum, niobium and manganese in the approximate atomic ratio of:

$$Ti_{51-45}Al_{46-50}Nb_2Mn_{1-3},$$

said alloy having been rapidly solidified and heat treated thereby giving a ductility of at least 2.0.

3. A niobium and manganese modified titanium aluminum alloy product consisting essentially of titanium, aluminum, niobium and manganese in the following approximate atomic ratio:

$$Ti_{51-43}Al_{46-50}Nb_{1-5}Mn_2,$$

said alloy having been rapidly solidified and heat treated thereby giving a ductility of at least 2.0.

4. A niobium and manganese modified titanium aluminum alloy product consisting essentially of titanium, aluminum, niobium and manganese in the approximate atomic ratio of:

$$Ti_{50-46}Al_{46-50}Nb_2Mn_2,$$

said alloy having been rapidly solidified and heat treated thereby giving a ductility of at least 2.0.

5. A niobium and manganese modified titanium aluminum alloy product consisting essentially of titanium, aluminum, niobium and manganese in the following approximate atomic ratio:

$$Ti_{49-47}Al_{47-49}Nb_2Mn_2,$$

said alloy having been rapidly solidified and heat treated thereby giving a ductility of at least 2.0.

6. A structural member, said member being formed of an alloy having the following composition in atomic percent:

$$Ti_{50-46}Al_{46-50}Nb_2Mn_2,$$

said alloy having been rapidly solidified and heat treated thereby giving a ductility of at least 2.0.

* * * * *